US010947794B2

(12) United States Patent
Noui-Mehidi

(10) Patent No.: US 10,947,794 B2
(45) Date of Patent: Mar. 16, 2021

(54) METHOD AND SYSTEM FOR EXTENDED REACH COILED TUBING

(71) Applicant: SAUDI ARABIAN OIL COMPANY, Dhahran (SA)

(72) Inventor: Mohamed Nabil Noui-Mehidi, Dhahran (SA)

(73) Assignee: SAUDI ARABIAN OIL COMPANY

( * ) Notice: Subject to any disclaimer, the term of this patent is extended or adjusted under 35 U.S.C. 154(b) by 74 days.

(21) Appl. No.: 16/289,882

(22) Filed: Mar. 1, 2019

(65) Prior Publication Data

US 2020/0277827 A1 Sep. 3, 2020

(51) Int. Cl.
*E21B 17/10* (2006.01)
*E21B 19/22* (2006.01)

(52) U.S. Cl.
CPC ..... *E21B 19/22* (2013.01); *E21B 17/1021* (2013.01); *E21B 17/1057* (2013.01)

(58) Field of Classification Search
CPC combination set(s) only.
See application file for complete search history.

(56) References Cited

U.S. PATENT DOCUMENTS 712,486 A * 11/1902 Black ..... E21B 17/1057 166/241.3
2,895,103 A * 7/1959 Vogt ..... G01N 27/9033 324/260
3,729,057 A * 4/1973 Werner ..... E21B 4/00 175/262
4,557,327 A 12/1985 Kinley et al.
4,830,105 A 5/1989 Petermann
5,355,950 A 10/1994 Zwart
5,358,040 A 10/1994 Kinley et al.
5,613,558 A 3/1997 Dillenbeck
5,692,563 A 12/1997 Krueger et al.
6,250,394 B1 6/2001 Mashburn
6,260,617 B1 7/2001 Baugh et al.
(Continued)

FOREIGN PATENT DOCUMENTS

CN 202483550 U 10/2012
EP 3239585 A1 11/2017

OTHER PUBLICATIONS

Afghoul, A., et al., "Coiled Tubing: The Next Generation" Oilfield Rev. 6 (4): pp. 38-57 (1994).
(Continued)

*Primary Examiner* — Giovanna Wright
*Assistant Examiner* — Ronald R Runyan
(74) *Attorney, Agent, or Firm* — Bracewell LLP; Constance Gall Rhebergen

(57) ABSTRACT

Embodiments provide a method for centralizing a coiled tubing in a wellbore. The method includes the step of supplying a roller set to a roller set assembly system located at a surface. The roller set includes a first half and a second half. The roller set assembly system includes a first guide cable and a second guide cable. The method includes the step of installing the first half to the first guide cable and the second half to the second guide cable. The method includes the step of securing the first half and the second half to the coiled tubing such that the roller set is fixed to the coiled tubing. The method includes the step of injecting the coiled tubing into the wellbore.

21 Claims, 4 Drawing Sheets

(56) References Cited

U.S. PATENT DOCUMENTS

| | | | |
|---|---|---|---|
| 6,339,993 | B1 | 1/2002 | Comello et al. |
| 7,421,914 | B2 | 9/2008 | Stanley et al. |
| 7,424,912 | B2 | 9/2008 | Reid |
| 9,222,316 | B2 | 12/2015 | Christie et al. |
| 2003/0233894 | A1 | 12/2003 | Tezuka et al. |
| 2010/0319998 | A1 | 12/2010 | Cooper et al. |
| 2014/0262216 | A1 | 9/2014 | Perry |
| 2015/0167402 | A1 | 6/2015 | Chang |

OTHER PUBLICATIONS

Alexander S.J. "Coiled Tubing: Operations and Services" World Oil. Nov. 1991 (pp. 41-47).
Bhalla, K. "Coiled Tubing Reach Technology" Offshore Europe conference; SPE 30404: pp. 392-405 (1995).
Chen, Y.C., et al. "Tubing and casing Buckling in Horizontal Wells" Offshore Technology Conference: JPT pp. 140-191; (Feb. 1990).
Gao, G., et al. "Effects of Boundary Conditions and Friction on Static Buckling of Pipe in a Horizontal Well". SPE Journal: 14 (4): (2009) pp. 782-796.
Jiang, W. "Torsion Load Effect on Drillstring Buckling" SPE 37477, (Mar. 1997): pp. 703-710.
Lubinski, A., et al. "Helical Buckling of Tubing Sealed in Packers" Journal of Petroleum Technology. 14: (1962) pp. 655-670.
Miller, J.T., et al. "Buckling-induced lock-up of a slender rod injected into a horizontal cylinder". International Journal of Solids and Structures 72 (2015) pp. 153-164.
International Search Report and Written Opinion for related PCT application PCT/US2020/019603 dated May 7, 2020.

* cited by examiner

METHOD AND SYSTEM FOR EXTENDED REACH COILED TUBING

BACKGROUND

Field of the Disclosure

Embodiments of the disclosure generally relate to coiled tubing operations. More specifically, embodiments of the disclosure relate to centralizing coiled tubing during coiled tubing operations in extended reach wells.

Description of the Related Art

Advancements have been made in the field of extended reach drilling (ERD), especially in developing tight formations for extracting shale gas. As an example, horizontal wells can be drilled using ERD having a horizontal displacement of over 10 kilometers. The ability to drill horizontally-oriented wells enables access to offshore fields from onshore locations. What follows these advancements in ERD are challenges related to accessing the entire length of the downhole environment for various purposes, for example, well stimulation or well logging.

Coiled tubing (CT), which is generally a single length of a continuous steel tubing, is frequently used for such intervention operations in horizontal wells. The use of CT is more efficient and cost-effective than using a conventional drilling rig in applications, such as long reach well stimulation, well clean out, and well logging. A typical CT rig includes a length of tubing (that is, CT) spooled around a reel. CT passes through a gooseneck and down through an injector head that pushes the tubing through the well head and into the well.

Inserting CT into a horizontal well is a challenging task because the CT tends to lie at the bottom part of the borehole creating friction in the opposite direction of insertion. Compressive axial load in the CT starts to build up and induces sinusoidal buckling followed by helical buckling. Further insertion of the CT may lead to a complete lock-up, where the CT cannot proceed further into the horizontal well. The lock-up phenomenon depends on many system characteristics, such as material of the CT itself, the well trajectory, and the force applied at the surface to insert the CT.

Downhole well tractors can be used to facilitate the delivery of the CT to the total depth of the well by pulling the CT in the uphole direction in the event the CT is locked up. However, downhole well tractor operations are relatively complex and require additional tools and equipment that are not cost-effective. In addition, downhole well tractor operations are not always successful depending on the well trajectory and other associated factors.

SUMMARY

Embodiments of the disclosure generally relate to CT operations. More specifically, embodiments of the disclosure relate to centralizing CT during CT operations in extended reach wells.

Embodiments of the disclosure describe an automated roller set assembly system to attach one or more roller sets to the CT in a cost and time saving manner. Advantageously, the automated roller set assembly system allows the CT to reach deep into the well, in some embodiments, to reach the total depth of the well, in a short timeframe relative to conventional CT operations.

Embodiments of the disclosure provide a method for centralizing a coiled tubing in a wellbore. The method includes the step of supplying a roller set to a roller set assembly system located at a surface. The roller set includes a first half and a second half. The roller set assembly system includes a first guide cable and a second guide cable. The method includes the step of installing the first half to the first guide cable and the second half to the second guide cable. The method includes the step of securing the first half and the second half to the coiled tubing such that the roller set is fixed to the coiled tubing. The method includes the step of injecting the coiled tubing into the wellbore.

In some embodiments, the method further includes the step of detaching the first half from the first guide cable and the second half from the second guide cable when the first half and the second half are secured or close to be secured to the coiled tubing.

In some embodiments, the first half includes a first hanger component and the second half includes a second hanger component such that the first hanger component and the second hanger component are hanging on the first guide cable and the second guide cable, respectively, in the installing step.

In some embodiments, the first half includes a first inner magnet and the second half includes a second inner magnet. The first inner magnet and the second inner magnet are located on inner circumferences of the first half and the second half, respectively, such that the first half and the second half are magnetically secured to the coiled tubing in the securing step.

In some embodiments, the first half includes a first set of one or more magnetic components located on one or more semicircular ends of the first half and the second half includes a second set of one or more magnetic components located on one or more semicircular ends of the second half, such that the first half and the second half are magnetically secured to each other in the securing step.

In some embodiments, the first half includes a first roller and the second half includes a second roller and a third roller, such that at least one of the first roller, the second roller, and the third roller is in contact with a wall of the wellbore in the injecting step. In some embodiments, the first half includes a first arm and the second half includes a second arm and a third arm. The first roller, the second roller, and the third roller are positioned at distal ends of the first arm, the second arm, and the third arm, respectively. In some embodiments, a proximate end of the first arm includes a first ball joint attached to an outer circumference of the first half. A proximate end of the second arm includes a second ball joint and a proximate end of the third arm includes a third ball joint. The second ball joint and the third ball joint are attached to an outer circumference of the second half. The first ball joint, the second ball joint, and the third ball joint allow the first arm, the second arm, and the third arm, respectively, to move with respect to a longitudinal axis of the coiled tubing. In some embodiments, the method further includes the step of withdrawing the coiled tubing injected into the wellbore. In some embodiments, an outermost diameter of the roller set is greater than a diameter of the wellbore.

In some embodiments, the coiled tubing includes a set of profiles on an outer circumference of the coiled tubing. The set of profiles positions the roller set to the coiled tubing.

In some embodiments, a plurality of roller sets is secured to the coiled tubing at predetermined intervals.

Embodiments of the disclosure also provide a method for centralizing a coiled tubing in a wellbore. The method includes the step of securing a roller set to the coiled tubing via a roller set assembly system at a surface. The roller set includes a first half including a first roller and a first set of one or more magnetic components. The roller set includes a second half including a second roller, a third roller, and a second set of one or more magnetic components. The first half and the second half are magnetically secured to the coiled tubing. The roller set assembly system includes a first guide cable and a second guide cable such that the first half is removably secured to the first guide cable and the second half is removably secured to the second guide cable. The method includes the step of injecting the coiled tubing into the wellbore. At least one of the first roller, the second roller, and the third roller is in contact with a wall of the wellbore to centralize the coiled tubing.

In some embodiments, the first half further includes a first hanger component and the second half further includes a second hanger component to removably secure the first half to the first guide cable and the second half to the second guide cable.

In some embodiments, the first half further includes a first arm and the second half further includes a second arm and a third arm. The first roller, the second roller, and the third roller are positioned at distal ends of the first arm, the second arm, and the third arm, respectively. In some embodiments, a proximate end of the first arm includes a first ball joint attached to an outer circumference of the first half. A proximate end of the second arm includes a second ball joint and a proximate end of the third arm includes a third ball joint. The second ball joint and the third ball joint are attached to an outer circumference of the second half. The first ball joint, the second ball joint, and the third ball joint allow the first arm, the second arm, and the third arm, respectively, to move with respect to a longitudinal axis of the coiled tubing.

In some embodiments, the coiled tubing includes a set of profiles on an outer circumference of the coiled tubing. The set of profiles positions the roller set to the coiled tubing.

Embodiments of the disclosure also provide a roller set assembly system for centralizing a coiled tubing in a wellbore. The roller set assembly system includes a roller set, a first guide cable, and a second guide cable. The roller set includes a first half including a first roller, a first hanger component, and a first set of one or more magnetic components. The roller set includes a second half including a second roller, a third roller, a second hanger component, and a second set of one or more magnetic components. The first half is configured to be removably secured to the first guide cable via the first hanger component and the second half is configured to be removably secured to the second guide cable via the second hanger component. The first half and the second half are configured to be magnetically secured to the coiled tubing. At least one of the first roller, the second roller, and the third roller is configured to be in contact with a wall of the wellbore to centralize the coiled tubing.

In some embodiments, the first half further includes a first arm and the second half further includes a second arm and a third arm. The first roller, the second roller, and the third roller are positioned at distal ends of the first arm, the second arm, and the third arm, respectively. In some embodiments, a proximate end of the first arm includes a first ball joint attached to an outer circumference of the first half. A proximate end of the second arm includes a second ball joint and a proximate end of the third arm includes a third ball joint. The second ball joint and the third ball joint are attached to an outer circumference of the second half. The first ball joint, the second ball joint, and the third ball joint is configured to allow the first arm, the second arm, and the third arm, respectively, to move with respect to a longitudinal axis of the coiled tubing.

BRIEF DESCRIPTION OF THE DRAWINGS

So that the manner in which the previously-recited features, aspects, and advantages of the embodiments of this disclosure as well as others that will become apparent are attained and can be understood in detail, a more particular description of the disclosure briefly summarized previously may be had by reference to the embodiments that are illustrated in the drawings that form a part of this specification. However, it is to be noted that the appended drawings illustrate only certain embodiments of the disclosure and are not to be considered limiting of the disclosure's scope as the disclosure may admit to other equally effective embodiments.

Figure 1:
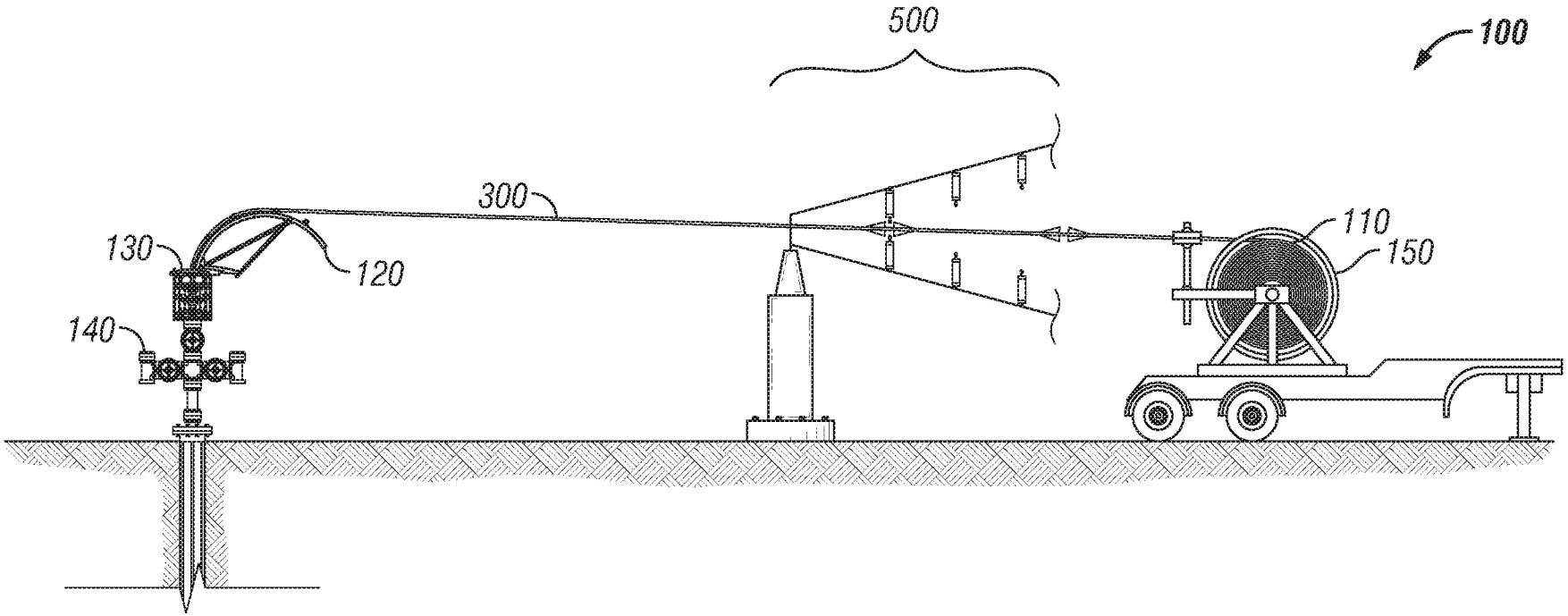
FIG. 1 is a schematic representation of a coiled tubing dispatching system according to at least one embodiment of the disclosure.

In the accompanying Figures, similar components or features, or both, may have a similar reference label.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the word "about" includes +/−5% of the cited magnitude.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided. "Substantial" means equal to or greater than 1% by the indicated unit of measure. "Significant" means equal to or greater than 0.1% of the indicated unit of measure. "Detectable" means equal to or greater than 0.01% by the indicated unit of measure.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words, including "uphole," "downhole" and other like terms, are for descriptive convenience and are not limiting unless otherwise indicated.

FIG. 1 shows a schematic representation of a coiled tubing dispatching system 100 according to at least one embodiment of the disclosure. The coiled tubing dispatching system 100 includes a reel 110, a roller set assembly system 500, a gooseneck 120, an injector head 130, and a well head 140. The CT 300 is reeled on a drum 150. The drum 150 can be loaded on a truck. A center control cabin (not shown) can be used to drive the injector head 130 to dispatch and retrieve the CT 300. The reel 110 may provide back tension on the CT 300. The roller set assembly system 500 is configured to install roller sets onto the CT 300. The roller sets can be installed onto the CT 300 at predetermined intervals. The CT 300, with the roller set installed, passes over the gooseneck 120 and through the injector head 130 and into the wellbore through the well head 140. Alternately, the roller set assembly system 500 can be placed between the gooseneck 120 and the injector head 130. After the CT 300 passes over the gooseneck 120, the roller sets can be installed onto the CT 300 before proceeding through the injector head 140. Alternately, the roller set assembly system 500 can be placed between the injector head 130 and the well head 140. After the CT 300 passes over the gooseneck 120 and through the injector head 130, the roller sets can be installed onto the CT 300 before being injected into the wellbore through the well head 140.

Figure 2A:
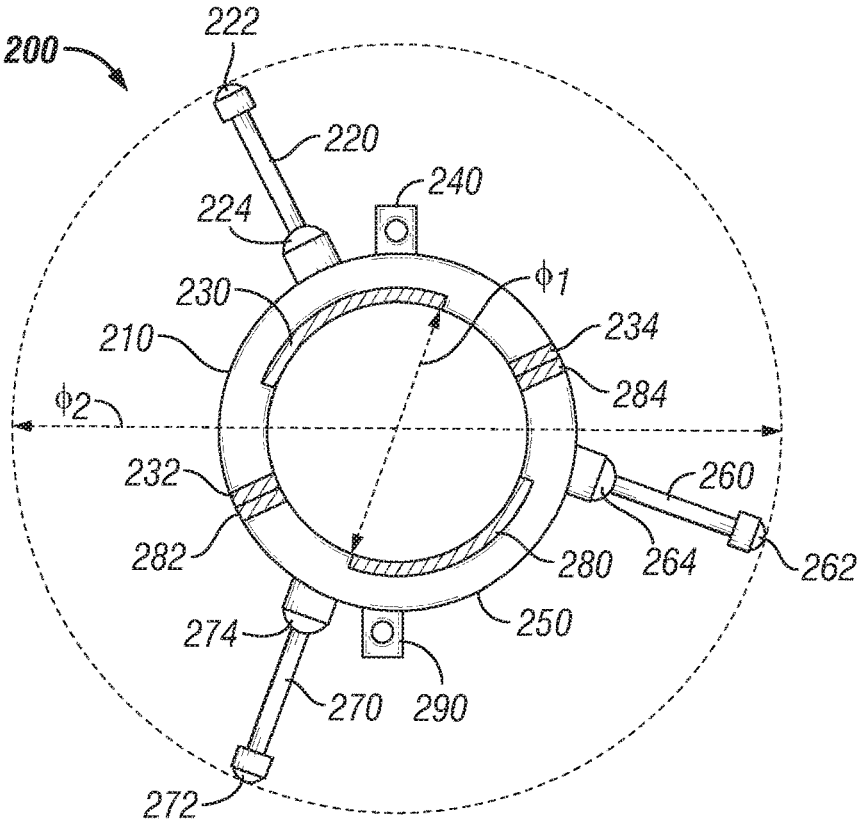
FIG. 2A is a top view of a roller set according to at least one embodiment of the disclosure.
Figure 2B:
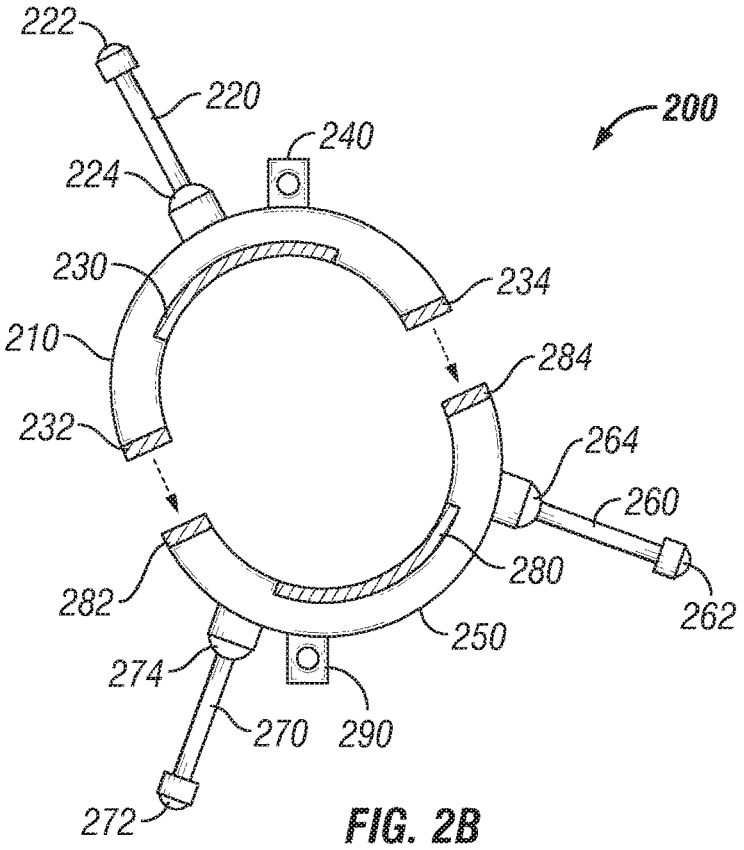
FIG. 2B is another top view of the roller set according to at least one embodiment of the disclosure.

FIG. 2A shows a top view of a roller set 200 according to at least one embodiment of the disclosure. FIG. 2B shows another top view of the roller set 200 according to at least one embodiment of the disclosure. The innermost diameter of the roller set 200, as shown as $\varphi_1$ in FIG. 2A, is substantially equal or greater than the outer diameter of the CT 300. The collar type roller set 200 includes at least three arms. Each arm includes a roller on the distal end. The roller is configured to rotate freely with friction against a wellbore wall. With the roller set 200 having at least three arms with rollers attached to the distal ends of the at least three arms, the CT 300 becomes centralized with respect to the wellbore. At least one of the rollers are in contact with the wellbore wall allowing the CT 300 to avoid contact with the wellbore wall, preventing the CT 300 from buckling while the CT 300 is injected downhole or retrieved uphole.

The roller set 200 includes two halves, a first half 210 and a second half 250. The first half 210 and the second half 250 are complementary to each other. One skilled in the relevant art would appreciate that the arcs of the first half 210 and the second half 250 need not be substantially 180 degrees but the sum of the two arcs would be 360 degrees. For example, the arc of the first half 210 can be greater than 180 degrees while the arc of the second half 250 can be lesser than 180 degrees. On the other hand, the arc of the first half 210 can be lesser than 180 degrees while the arc of the second half 250 can be greater than 180 degrees. The first half 210 includes one arm 220 where the proximate end of the arm 220 is located on the outer circumference of the first half 210 via ball joint 224. The second half 250 includes two arms 260, 270 where the proximate ends of the two arms 260, 270 are located on the outer circumference of the second half 250 via ball joints 264, 274, respectively. In some embodiments, the first half 210 can include two arms while the second half 250 includes one arm. In other embodiments, the first half 210 and the second half 250 may both include more than one arm. The ball joints 224, 264, 274 allow the distal ends of the arms 220, 260, 270 to move with respect to the longitudinal axis of the CT. A spring loading mechanism can be included in each of the arms 220, 260, 270 or the ball joints 224, 264, 274. In some embodiments, the arms 220, 260, 270 can have fixed lengths. The arms 220, 260, 270 can be substantially equal in length. In other embodiments, the arms 220, 260, 270 can be retractable or extendable. Each of the arms 220, 260, 270 includes a roller 222, 262, 272 attached to the distal end, respectively. The rollers 222, 262, 272 are configured to rotate freely with friction to the wellbore wall. In some embodiments, the outermost diameter of the roller set 200, as shown as $\varphi_2$ in FIG. 2A, is greater than the diameter of the wellbore. This way, at least one of the rollers 222, 262, 272 can be in contact with the wellbore wall.

The first half 210 and the second half 250 include magnetic components. Magnetic components may include permanent magnets and electromagnets. In some embodiments, magnetic components are located on the inner circumference of the first half 210 and the second half 250. A first inner magnet 230 is located on the inner circumference of the first half 210. A second inner magnet 280 is located on the inner circumference of the second half 250. Both the first inner magnet 230 and the second inner magnet 280 is configured to be magnetically secured to the CT 300. This way, the first half 210 and the second half 250 can be secured to the CT 300 as an integrated roller set 200. In some embodiments, magnetic components are located on the semicircular ends of the first half 210 and the second half 250. A first set of magnetic components 232, 234 is located on the two semicircular ends of the first half 210. A second set of magnetic components 282, 284 are located on the two semicircular ends of the second half 250. Magnetic component 232 and magnetic component 282 are configured to be magnetically secured to each other. This implies that magnetic component 232 and magnetic component 282 have opposite polarities. Similarly, magnetic component 234 and magnetic component 284 are configured to be magnetically secured to each other. This implies that magnetic component 234 and magnetic component 284 have opposite polarities. This way, the first half 210 and the second half 250 can be secured to each other as in integrated roller set 200. In other embodiments, the first half 210 includes magnetic component 232 on only one of the two semicircular ends of the first half 210, corresponding to the nonmagnetic semicircular end of the second half 250. The second half 250 includes magnetic component 284 on only one of the two semicircular ends of the second half 250, corresponding to the nonmagnetic semicircular end of the first half 210. Still in other embodiments, the first half 210 includes magnetic component 234 on only one of the two semicircular ends of the first half 210, corresponding to the nonmagnetic semicircular end of the second half 250. The second half 250 includes magnetic component 282 on only one of the two semicircular ends of the second half 250, corresponding to the nonmagnetic semicircular end of the first half 210.

The first half 210 and the second half 250 include hanger components. A first hanger component 240 is located on the outer circumference of the first half 210. A second hanger component 290 is located on the outer circumference of the second half 250. Both the first hanger component 240 and the second hanger component 290 are configured to be removably or temporarily hanging on corresponding guide cables included in the roller set assembly system 500. When the roller set 200 is secured or close to be secured on the CT 300, both the first hanger component 240 and the second hanger component 290 detaches from the corresponding guide cables.

Figure 3:
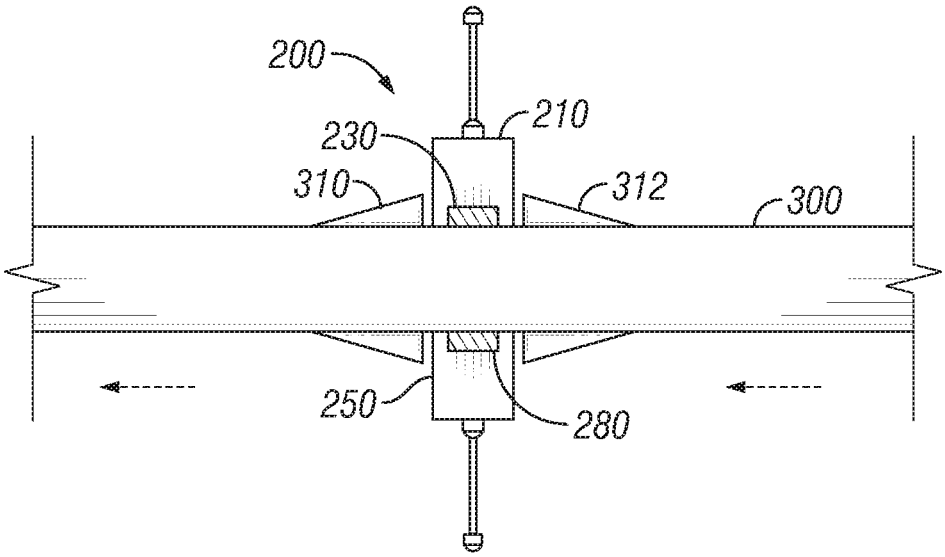
FIG. 3 is a cross-sectional view of the roller set secured to a CT according to at least one embodiment of the disclosure.

FIG. 3 shows a cross-sectional view of the roller set 200 secured to the CT 300 according to at least one embodiment of the disclosure. The dotted arrows indicate the downhole direction of the CT 300. The first half 210 is secured to the CT 300 where the first inner magnet 230 magnetically secures to the CT 300. The second half 250 is secured to the CT 300 where the second inner magnet 280 magnetically secures to the CT 300. In some embodiments, the CT 300 includes a set of profiles 310, 312. More than one set of profiles 310, 312 can be positioned along the CT 300 at predetermined intervals. In some embodiments, the profiles 310, 312 fully occupy the outer circumference of the CT 300. In other embodiments, the profiles 310, 312 partially occupy the outer circumference of the CT 300. The distance between the two profiles 310, 312, with respect to the longitudinal axis of the CT 300, is equal or greater than the thickness of both the first half 210 and the second half 250 of the roller set 200. This way, a plurality of roller sets 200 can be accurately positioned on the CT 300 at predetermined intervals by securing individual roller sets 200 between a set of profiles such as profiles 310, 312.

Figure 4B:
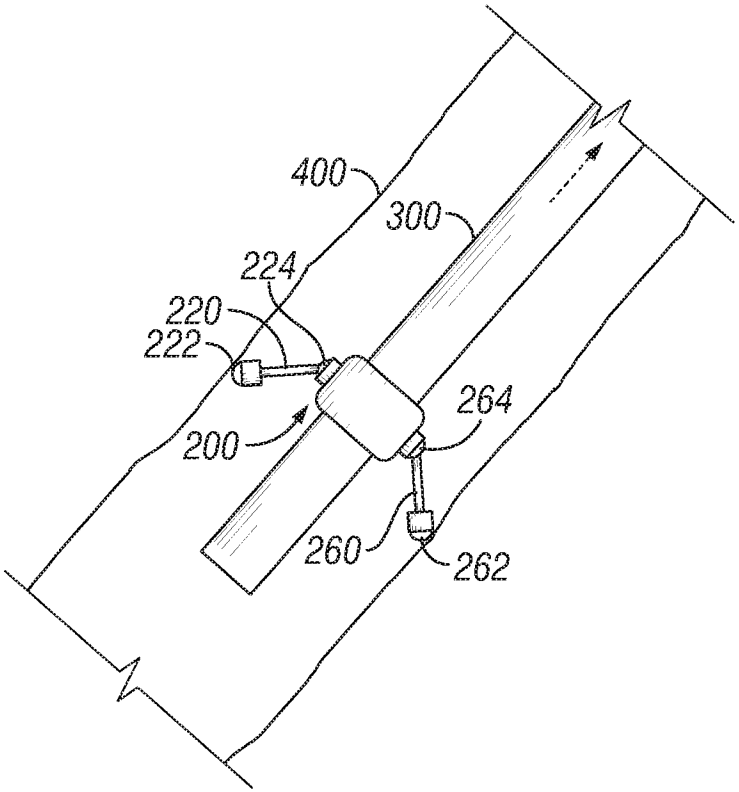
FIG. 4B is a schematic representation of the roller set secured to the CT where the CT is progressing uphole in a wellbore.
Figure 4A:
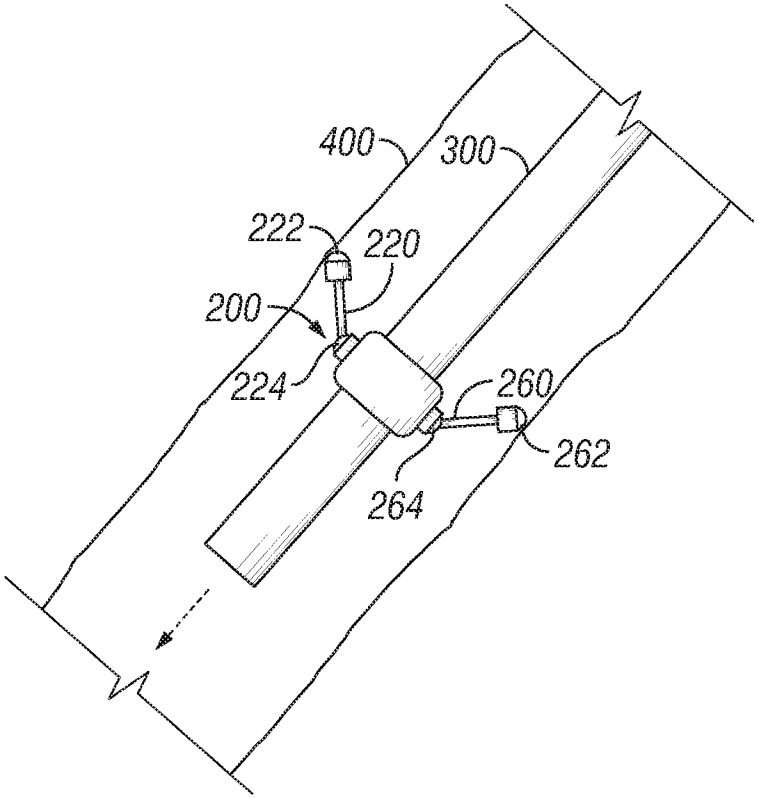
FIG. 4A is a schematic representation of the roller set secured to the CT where the CT is progressing downhole in a wellbore.

FIG. 4A shows a schematic representation of the roller set 200 secured to the CT 300 where the CT 300 is progressing downhole in a wellbore. The dotted arrow indicates the downhole direction of the CT 300. The roller set 200 allows the CT 300 to be centralized in the wellbore. The roller set 200 as an integrated unit is secured to the CT 300, where rollers 222, 262 (attached to the distal ends of arms 220, 260) are in contact with the wellbore wall 400. The rollers 222, 262 are configured to rotate freely with friction against the wellbore wall 400. Accordingly, the roller set 200 allows the CT 300 to avoid contact with the wellbore wall 400, preventing the CT 300 from buckling while the CT 300 is injected downhole. Because the outermost diameter of the roller set 200 (as shown as $\varphi_2$ in FIG. 2A) is greater than the diameter of the wellbore, the arms 220, 260 (including the rollers 222, 262) are directed opposite to the movement direction of the CT 300. Ball joints 224, 264 allow the arms 220, 260 to move with respect to the longitudinal axis of the CT 300.

FIG. 4B shows a schematic representation of the roller set 200 secured to the CT 300 where the CT 300 is progressing uphole in a wellbore. The dotted arrow indicates the uphole direction of the CT 300. The roller set 200 allows the CT 300 to be centralized in the wellbore. The roller set 200 as an integrated unit is secured to the CT 300, where rollers 222, 262 (attached to the distal ends of arms 220, 260) are in contact with the wellbore wall 400. The rollers 222, 262 are configured to rotate freely with friction against the wellbore wall 400. Accordingly, the roller set 200 allows the CT 300 to avoid contact with the wellbore wall 400, preventing the CT 300 from buckling while the CT 300 is withdrawn uphole. Because the outermost diameter of the roller set 200 (as shown as $\varphi_2$ in FIG. 2A) is greater than the diameter of the wellbore, the arms 220, 260 (including the rollers 222, 262) are directed opposite to the movement direction of the CT 300. Ball joints 224, 264 allow the arms 220, 260 to move with respect to the longitudinal axis of the CT 300.

In cases where the injection of the CT 300 is halted and the CT 300 is subsequently withdrawn, due to the proximate ends of the arms 220, 260 having ball joints 224, 264, respectively, the arms 220, 260 (including the rollers 222, 262) as shown in FIG. 4A can be flipped to the opposite direction with respect to the longitudinal axis of the CT 300, as shown in FIG. 4B. In some embodiments, the arms 220, 260 can be flipped from one side to the other when the roller set 200 is positioned in the openhole section of the well while withdrawing the CT 300, where the diameter of the openhole section is greater than that of the cased section of the well. Oppositely, in cases where the withdrawal of the CT 300 is halted and the CT 300 is subsequently injected, due to the proximate ends of the arms 220, 260 having ball joints 224, 264, respectively, the arms 220, 260 (including the rollers 222, 262) as shown in FIG. 4B can be flipped to the opposite direction with respect to the longitudinal axis of the CT 300, as shown in FIG. 4A.

Figure 5:
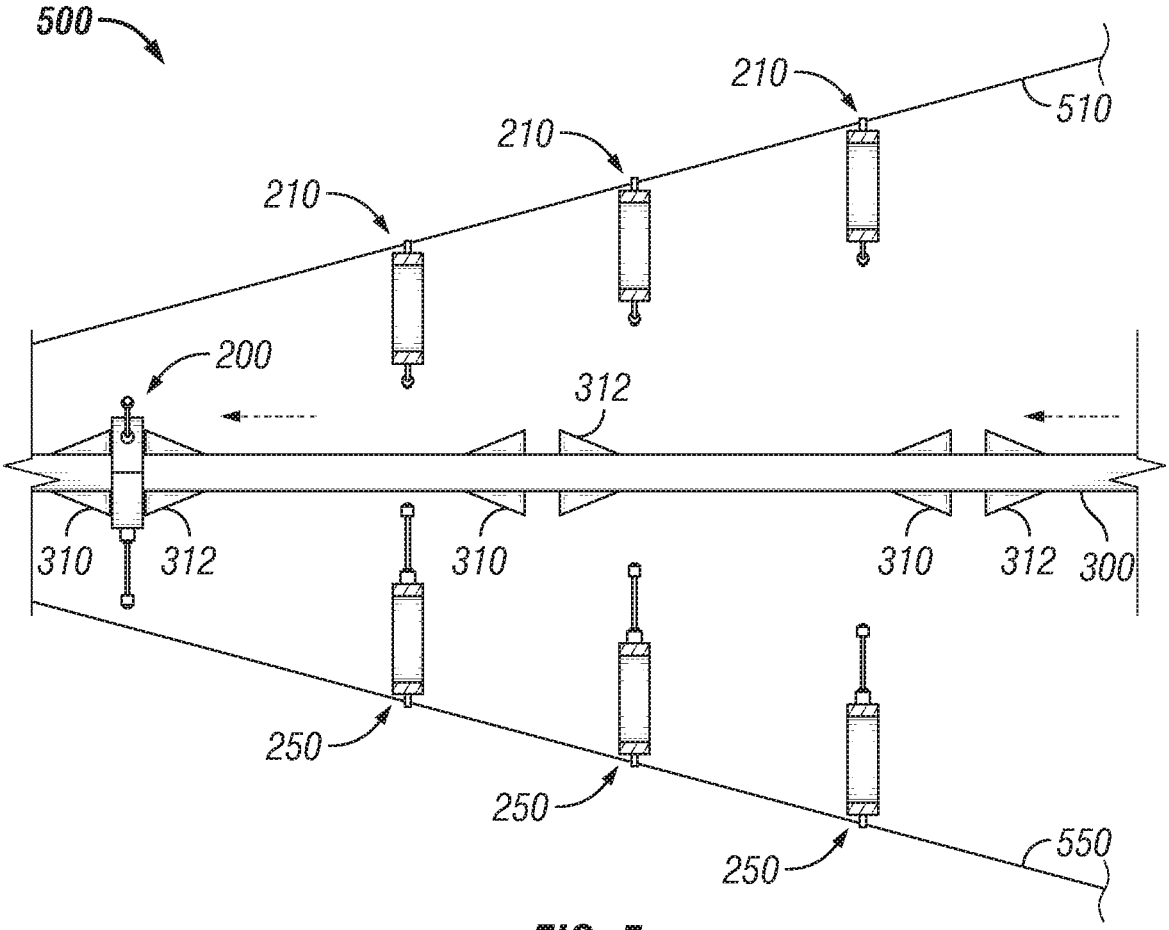
FIG. 5 is a schematic representation of a roller set assembly system according to at least one embodiment of the disclosure.

FIG. 5 shows a schematic representation of the roller set assembly system 500 according to at least one embodiment of the disclosure. The dotted arrows indicate the downhole direction of the CT 300. Similarly as shown in FIG. 3, the CT 300 includes sets of profiles 310, 312. Each set of profiles 310, 312 is positioned along the CT 300 at predetermined intervals.

The roller set assembly system 500 includes two guide cables, a first guide cable 510 and a second guide cable 550.

The first guide cable 510 is configured to hold one or more of the first half 210 of the roller set 200 via the first hanger component 240. The second guide cable 550 is configured to hold one or more of the second half 250 of the roller set 200 via the second hanger component 290. The first guide cable 510 and the second guide cable 550 converge towards the CT 300 in the downhole direction (indicated by the dotted arrows). As the CT 300 progresses to the downhole direction, the first half 210 and the second half 250 of the roller set 200 are secured to the CT 300 between profiles 310, 312. As shown in FIG. 2, the first half 210 and the second half 250 of the roller set 200 can be secured to the CT 300 via the first inner magnet 230 and the second inner magnet 280. The first half 210 and the second half 250 of the roller set 200 can be secured to each other via the first set of magnetic components 232, 234 and the second set of magnetic components 282, 284. When the first half 210 and the second half 250 of the roller set 200 are secured or close to be secured on the CT 300 between profiles 310, 312, the first hanger component 240 of the first half 210 detaches from the first guide cable 510 and the second hanger component 290 of the second half 250 detaches from the second guide cable 550, such that the roller set 200 is fully secured to the CT 300 and is no longer in connection with the first guide cable 510 and the second guide cable 550. An example of a fully secured roller set 200 detached from the first guide cable 510 and the second guide cable 550 is shown on the downhole-most side of FIG. 5.

In an example embodiment of the method, a roller set 200 is supplied to the roller set assembly system 500. The roller set assembly system 500 is positioned at the surface near the location of the well. The first half 210 of the roller set 200 is removably installed to the first guide cable 510 via the first hanger component 240. More than one first halves 210, such as a magazine of first halves 210, can be installed to the first guide cable 510. The second half 250 of the roller set 200 is removably installed to the second guide cable 550 via the second hanger component 290. More than one second halves 250, such as a magazine of second halves 250, can be installed to the second guide cable 550. The first guide cable 510 and the second guide cable 550 converge towards the CT 300 in the downhole direction. The CT 300 may include a set or sets of profiles 310, 312 to accurately position the roller set 200 to the moving or at least intermittently moving CT 300 (in the downhole direction). The first half 210 and the second half 250, both hanging on guide cables 510, 520 and waiting to be secured to the moving CT 300, become secured to the moving CT 300 substantially immediately after profile 310 of the moving CT 300 passes the first half 210 and the second half 250. The first inner magnet 230 of the first half 210 allow the first half 210 to be secured to the CT 300. The second inner magnet 280 of the second half 250 allow the second half 250 to be secured to the CT 300. One or more magnetic components 232, 234 of the first half 210 and one or more magnetic components 282, 284 of the second half 250 allow the first half 210 and the second half 250 to be secured to each other while the first half 210 and the second half 250 are secured to the CT 300. When the roller set 200 is secured or close to be secured to the CT 300, both the first hanger component 240 detaches from the first guide cable 510 and the second hanger component 290 detaches from the second guide cable 550. The roller set 200 is fully secured to the CT 300 and subsequently enters the wellbore centralizing the CT 300. The sequence can be repeated as many times such that a plurality of roller sets 200 can be fully secured to the CT 300 at predetermined intervals.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A method for centralizing a coiled tubing in a wellbore, the method comprising:

supplying a roller set to a roller set assembly system located at a surface, the roller set comprising a first half and a second half, the roller set assembly system comprising a first guide cable and a second guide cable;

installing the first half to the first guide cable and the second half to the second guide cable;

securing the first half and the second half to the coiled tubing such that the roller set is fixed to the coiled tubing; and injecting the coiled tubing into the wellbore.

2. The method of claim 1, further comprising:

detaching the first half from the first guide cable and the second half from the second guide cable when the first half and the second half are secured or close to be secured to the coiled tubing.

3. The method of claim 1, wherein the first half includes a first hanger component and the second half includes a second hanger component such that the first hanger component and the second hanger component are hanging on the first guide cable and the second guide cable, respectively, in the installing step.

4. The method of claim 1, wherein the first half includes a first inner magnet and the second half includes a second inner magnet, the first inner magnet and the second inner magnet located on inner circumferences of the first half and the second half, respectively, such that the first half and the second half are magnetically secured to the coiled tubing in the securing step.

5. The method of claim 1, wherein the first half includes a first set of one or more magnetic components located on one or more semicircular ends of the first half and the second half includes a second set of one or more magnetic components located on one or more semicircular ends of the second half, such that the first half and the second half are magnetically secured to each other in the securing step.

6. The method of claim 1, wherein the first half includes a first roller and the second half includes a second roller and a third roller, such that at least one of the first roller, the second roller, and the third roller is in contact with a wall of the wellbore in the injecting step.

7. The method of claim 6, wherein the first half includes a first arm and the second half includes a second arm and a third arm, wherein the first roller, the second roller, and the third roller are positioned at distal ends of the first arm, the second arm, and the third arm, respectively.

8. The method of claim 7, wherein a proximate end of the first arm includes a first ball joint attached to an outer circumference of the first half, wherein a proximate end of the second arm includes a second ball joint and a proximate end of the third arm includes a third ball joint, the second ball joint and the third ball joint attached to an outer circumference of the second half, and wherein the first ball joint, the second ball joint, and the third ball joint allow the first arm, the second arm, and the third arm, respectively, to move with respect to a longitudinal axis of the coiled tubing.

9. The method of claim 8, further comprising:

withdrawing the coiled tubing injected into the wellbore.

10. The method of claim 7, wherein an outermost diameter of the roller set is greater than a diameter of the wellbore.

11. The method of claim 1, wherein the coiled tubing includes a set of profiles on an outer circumference of the coiled tubing, wherein the set of profiles positions the roller set to the coiled tubing.

12. The method of claim 1, wherein a plurality of roller sets is secured to the coiled tubing at predetermined intervals.

13. A method for centralizing a coiled tubing in a wellbore, the method comprising:

securing a roller set to the coiled tubing via a roller set assembly system at a surface, the roller set comprising:

a first half including a first roller and a first set of one or more magnetic components; and a second half including a second roller, a third roller, and a second set of one or more magnetic components, wherein the first half and the second half are magnetically secured to the coiled tubing, wherein the roller set assembly system comprises a first guide cable and a second guide cable such that the first half is removably secured to the first guide cable and the second half is removably secured to the second guide cable; and injecting the coiled tubing into the wellbore, wherein at least one of the first roller, the second roller, and the third roller is in contact with a wall of the wellbore to centralize the coiled tubing.

14. The method of claim 13, wherein the first half further includes a first hanger component and the second half further includes a second hanger component to removably secure the first half to the first guide cable and the second half to the second guide cable.

15. The method of claim 13, wherein the first half further includes a first arm and the second half further includes a second arm and a third arm, wherein the first roller, the second roller, and the third roller are positioned at distal ends of the first arm, the second arm, and the third arm, respectively.

16. The method of claim 15, wherein a proximate end of the first arm includes a first ball joint attached to an outer circumference of the first half, wherein a proximate end of the second arm includes a second ball joint and a proximate end of the third arm includes a third ball joint, the second ball joint and the third ball joint attached to an outer circumference of the second half, and wherein the first ball joint, the second ball joint, and the third ball joint allow the first arm, the second arm, and the third arm, respectively, to move with respect to a longitudinal axis of the coiled tubing.

17. The method of claim 13, wherein the coiled tubing includes a set of profiles on an outer circumference of the coiled tubing, wherein the set of profiles positions the roller set to the coiled tubing.

18. A roller set assembly system for centralizing a coiled tubing in a wellbore, the roller set assembly system comprising:

a roller set, the roller set comprising:

a first half including a first roller, a first hanger component, and a first set of one or more magnetic components; and a second half including a second roller, a third roller, a second hanger component, and a second set of one or more magnetic components;

a first guide cable configured to releasively bring the first half to be secured to the coiled tubing; and a second guide cable configured to releasively bring the second half to be secured to the coiled tubing, wherein the first half is configured to be removably secured to the first guide cable via the first hanger component and the second half is configured to be removably secured to the second guide cable via the second hanger component;

wherein the first half and the second half are configured to be magnetically secured to the coiled tubing and to be magnetically secured to each other, and wherein at least one of the first roller, the second roller, and the third roller is configured to be in contact with a wall of the wellbore to centralize the coiled tubing.

19. The roller set assembly system of claim 18, wherein the first half further includes a first arm and the second half further includes a second arm and a third arm, wherein the first roller, the second roller, and the third roller are positioned at distal ends of the first arm, the second arm, and the third arm, respectively.

20. The roller set assembly system of claim 19, wherein a proximate end of the first arm includes a first ball joint attached to an outer circumference of the first half, wherein a proximate end of the second arm includes a second ball joint and a proximate end of the third arm includes a third ball joint, the second ball joint and the third ball joint attached to an outer circumference of the second half, and wherein the first ball joint, the second ball joint, and the third ball joint is configured to allow the first arm, the second arm, and the third arm, respectively, to move with respect to a longitudinal axis of the coiled tubing.

21. A roller set assembly system for centralizing a coiled tubing in a wellbore, the roller set assembly system comprising:

a roller set, the roller set comprising:

a first half including a first roller, a first hanger component, and a first set of one or more magnetic components; and a second half including a second roller, a third roller, a second hanger component, and a second set of one or more magnetic components;

a first guide cable; and a second guide cable, wherein the first half is configured to be removably secured to the first guide cable via the first hanger component and the second half is configured to be removably secured to the second guide cable via the second hanger component;

wherein the first half and the second half are configured to be magnetically secured to the coiled tubing, wherein at least one of the first roller, the second roller, and the third roller is configured to be in contact with a wall of the wellbore to centralize the coiled tubing, wherein the first half further includes a first arm and the second half further includes a second arm and a third arm, wherein the first roller, the second roller, and the third roller are positioned at distal ends of the first arm, the second arm, and the third arm, respectively, wherein a proximate end of the first arm includes a first ball joint attached to an outer circumference of the first half, wherein a proximate end of the second arm includes a second ball joint and a proximate end of the third arm includes a third ball joint, the second ball joint and the third ball joint attached to an outer circumference of the second half, and wherein the first ball joint, the second ball joint, and the third ball joint is configured to allow the first arm, the second arm, and the third arm, respectively, to move with respect to a longitudinal axis of the coiled tubing.

* * * * *